United States Patent [19]

Belbel et al.

[11] Patent Number: 4,677,266

[45] Date of Patent: Jun. 30, 1987

[54] SWITCH DEVICE HAVING AN INSULATING SCREEN INSERTED BETWEEN THE CONTACTS DURING BREAKING

[75] Inventors: Elie Belbel, Epinay sur Seine; Christian Blanchard, Nanterre; André Haury, Le Raincy; Michel Lauraire, Courbevoie, all of France

[73] Assignee: La Telemecanique Electrique, France

[21] Appl. No.: 802,093

[22] Filed: Nov. 25, 1985

[51] Int. Cl.[4] ..... H01H 33/06

[52] U.S. Cl. ..... 200/151; 200/148 R

[58] Field of Search ..... 200/148 R, 148 A, 151, 200/144 R

[56] References Cited

U.S. PATENT DOCUMENTS

| | | | |
|---|---|---|---|
| 3,281,561 | 10/1966 | Marx | 200/151 X |
| 3,542,986 | 11/1970 | Kotski | 200/151 X |
| 4,082,932 | 4/1978 | Rozier | 200/148 R |
| 4,293,750 | 10/1981 | Marin | 200/148 A |
| 4,342,978 | 8/1982 | Meister | 200/151 X |
| 4,370,531 | 1/1983 | Tobin | 200/151 |
| 4,471,188 | 9/1984 | Van et al. | 200/148 R |
| 4,536,630 | 8/1985 | Bebel et al. | 200/151 |
| 4,562,323 | 12/1985 | Bebel et al. | 200/151 |

*Primary Examiner*—Mark O. Budd

*Attorney, Agent, or Firm*—William A. Drucker

[57] ABSTRACT

A switch in which a screen inserted between the contacts shears the opening arc. The screen is associated with a sheath that surrounds a contact support and slides on the latter when the gas pressure it is subjected to causes it to move at a velocity which is a function of the energy of the arc. The switch is applicable in particular to protective apparatus designed to limit fault current or breaking devices in which steady-state current is fairly high.

12 Claims, 8 Drawing Figures

FIG. 1
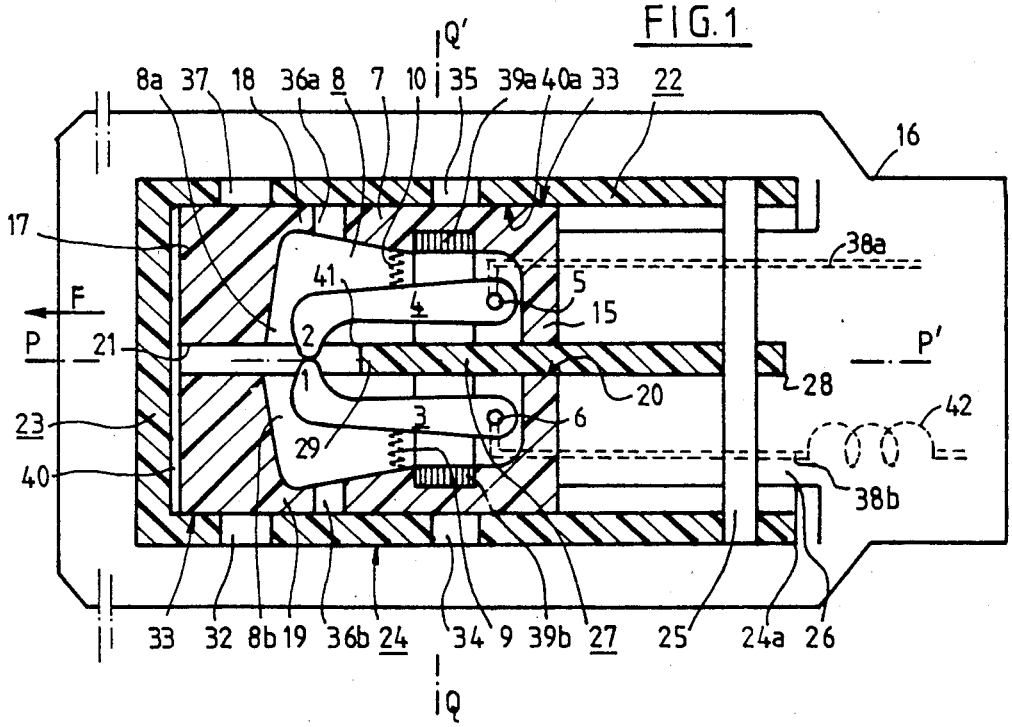
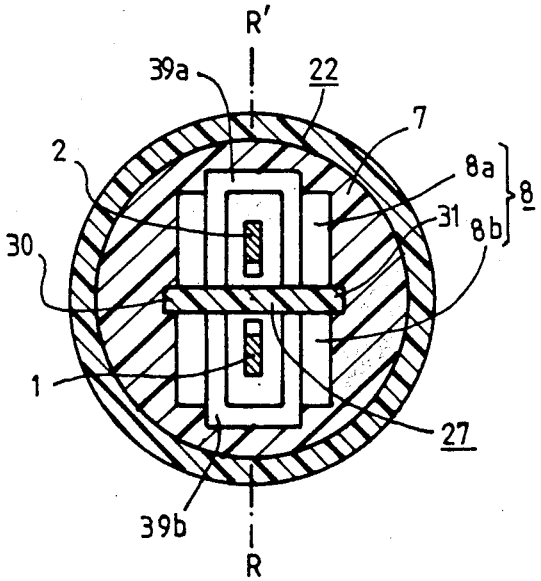
FIG. 2

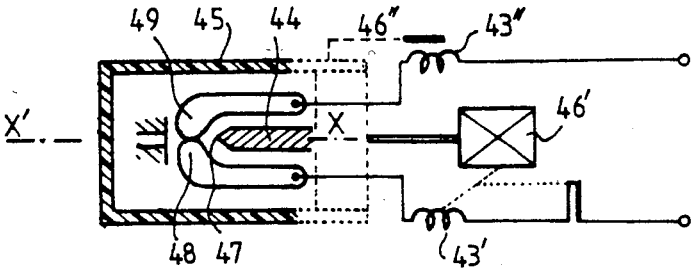
FIG. 3
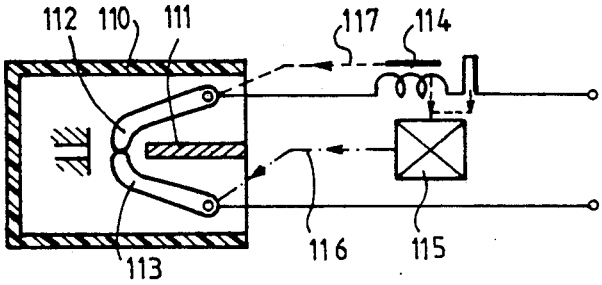
FIG. 4
FIG. 5
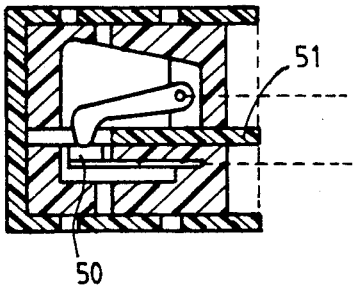
FIG. 6
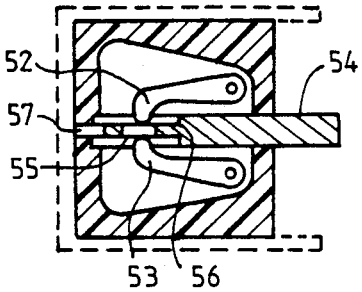
FIG. 7
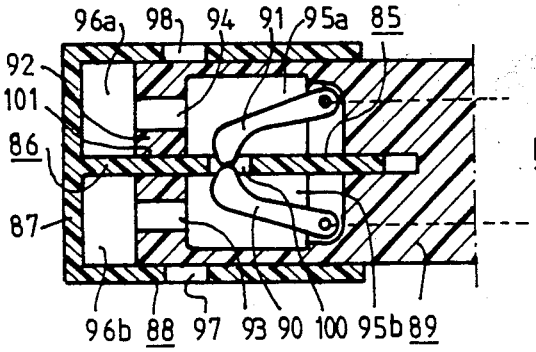
FIG. 8
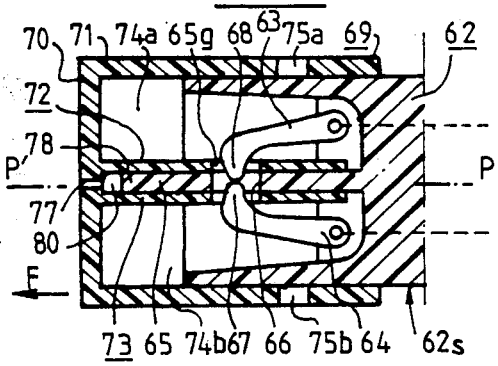

SWITCH DEVICE HAVING AN INSULATING SCREEN INSERTED BETWEEN THE CONTACTS DURING BREAKING

BACKGROUND OF THE INVENTION

1. Field of the Invention

The invention relates to an electric switch wherein a housing contains an insulating screen which is inserted at high speed between the two contacts to de-stabilize the arc that strikes when the contacts part by shearing the arc against a neighbouring insulating wall.

Switches of this type, which result in extremely fast current breaking, can be used to advantage either in apparatus or combinations of apparatus designed specifically to protect lines against short-circuit currents, or else in breaking devices designed to open on high steady-state currents.

2. Description of the Prior Art

Screened switches such as those described above are already known, wherein the screen is propelled either by electro-magnetic devices assembled in series, or by elastic means.

In any case, it is not easy to establish a synchronism and/or relation between the screen motion speed and the increase rate or level of the current to be opened; the purpose of the invention is therefore to provide suitable means so that a screened switch is able to open current in such a way that breaking speed increases as current increases, and to take advantage of the energy of the arc that strikes when the contacts part.

SUMMARY OF THE INVENTION

With the invention, the purpose is attained owing to the fact that the two contacts of the switch are borne by a fixed insulating support, surrounded by the sliding skirt of a mobile insulating case, the internal volume of which, enclosed between a bottom of this sheath acting as a driving component when exposed to the gas pressure and the contact support mentioned, houses the two contacts, whilst the screen is displaced by the movement of the sheath at least at the moment when the arc is sheared.

Various embodiments of the switch, designed in particular and without any restriction to enable the incorporation of the switch in generally cylindrical housings similar to those used for fuses or small distribution circuit-breakers, must not be considered in any way as an intention to restrict the scope of use of the invention to such technical areas.

BRIEF DESCRIPTION OF THE DRAWINGS

The invention and some embodiments thereof will be better understood from the description below with reference to the drawings attached, wherein:

FIGS. 1 and 2 show an elevation with a centerline cross-section by plane RR′ and a side view transversally cut away by the plane QQ′, of an embodiment in which the screen is pushed by the sheath, and the switch operates as a current-limiting device;

FIGS. 3 and 4 outline a possible implementation of the switch in a circuit breaker type device;

FIG. 5 shows a simplified cross-section of a switch that resembles the general description of FIG. 1, but involves a fixed contact and a mobile contact;

FIG. 6 shows a simplified cross-section of a contact device, for a switch according to the invention, wherein the screen holds a contact pad comprised between two mobile contacts; and FIGS. 7 and 8 illustrate centerline cross-sections of two switches according to the invention in which the screen is pulled by the sheath.

DESCRIPTION OF THE PREFERRED EMBODIMENT

As illustrated in FIG. 1, the switch features two contacts 1, 2 which in this case are both mobile. These contacts are for instance borne by two symmetrical and parallel levers 3, 4 which pivot around 5, 6 in a chamber 8 inside a fixed insulating support part 7 and contact pressure is ensured by springs indicated schematically by 9, 10 acting on the said levers.

Contact-opening devices may differ according to the purpose of the circuit breaking; if the switch is designed to act as a protection against heavy overcurrents in its circuit, each one of the levers described above may be driven by a transmission shaft coupled to a magnetizable frame or core, which in turn is pulled by a coil provided in series with the contacts; if the value of the current to be opened are as high as limit values associated with full short-circuits, the levers may be operated by the electro-dynamic forces developed in the levers, on one hand owing to the loop effect and on the other hand thanks to the known use of U-shaped magnetizable attraction parts.

An insulating support part 7 includes a base 15 which is e.g. joined to a housing 16 of the apparatus, and a transversal bottom 17 held by the sides 18, 19; a first opening 20 through the base is aligned with a second opening 21 through the bottom in a plane PP′ which is basically a symmetry plane. The outer surface 33 of the insulating part is e.g. cylindrical, see FIG. 1, and is fitted with a sliding clearance in an insulating sheath 22, preferably cylindrical, one end of which 23 is located at rest near the bottom 17 and which has a skirt 24 that carries near its end 24*a* a transversal pin 25 designed to move in an oblong slot 26 in the insulating part parallel to plane RR′; this slot extends up to the first opening 20 through which a thin insulating screen 27 slides, coupled at one end 28 outside chamber 8, to the pin 25 which in turn is connected to the skirt 24. In the idle position of the switch as illustrated, the opposite end 29 of the same screen is near the switch contacts.

It can be seen that in this layout the screen moves at the same time as the sheath and that in a particular sheath position the tip 29 is inserted between the contacts when they are open and then, with no detectable clearance, goes into opening 21, hence dividing chamber 8 into two half-chambers 8*a*, 8*b* which are insulated from each other by baffled overlaps (30, 31) between the longitudinal edges of the screen 27 and insulating part 7, see FIG. 2. The contacts are within the inner volume 40*a* of the sheath.

For this particular position of the sheath and of the screen or during motion towards this position, one set of vents 32, 37 in the skirt leave the cylindrical surface 33 of the insulating part where they were positioned, whilst a second set of vents 34, 35 in the same skirt comes in front of openings such as 36*a*, 36*b*, leading to chambers 8*a*, 8*b* respectively.

In the embodiment illustrated here, the magnitude of the forces that separate the contact levers by electrodynamic repulsion when an overcurrent flows through, arriving for instance through conductors 38*a*, 38*b* connected to the line, is enhanced by providing U-shaped magnetizable structures 39*a*, 39*b* surrounding the levers. Shock-absorbing devices are provided between the housing and the sheath to prevent the latter from bouncing at the end of its stroke, and also resetting devices to return the sheath to the position shown in the opposite direction to F.

In this case the switch operates when an overcurrent flows in the circuit, since the overcurrent first causes the contacts to part; as soon as this occurs, the arc arising between them causes a pressure in chamber 8, which is transferred through the second opening 21 to the volume 40 located between bottoms 17, 23 and impels the sheath in the direction indicated by the arrow F. As a result of this extremely fast motion the edge 41 of the screen shears the arc against the partition 17 and simultaneously establishes total electric insulation between the half-chambers 8*a* and 8*b*.

The gases released by the arc generation then escape through the vents, and the volume and the two half-chambers return to atmospheric pressure.

After opening this way, the contacts can either return to the idle position and thus bear on the opposite faces of the screen, or else be held open by locks not shown or by devices driven by a mechanism coupled to a magnetizable frame or core associated to a series mounted coil 42.

In the switch just described, the two contacts, housed in a volume enclosed by the sheath, open before the screen starts moving.

In an embodiment sketched in FIG. 3, the screen 44 or the sheath 45 if there is no play between them, are moved suddenly either by an elastic mechanism 46' previously set and released by the core or frame of a magnetic coil 43', or else directly by devices 43'', 46''; in this case, the end 47 of the screen has a bevelled leading edge to separate the two contacts 48, 49, and the arc which is then generated causes as previously a movement of the sheath which is compounded with the mechanism or core effect, but only after the contacts have parted.

As in the example in FIG. 1, where contacts open before the screen starts moving, the screen 44 and the sheath 45 can be associated with a measure of axial clearance XX' so that when the screen is moved by the device 46 it first causes an initial opening of the contacts, and the rapid arc shearing movement is then produced when the screen is impelled by the sheath.

In FIG. 4, the sheath 110 and the screen 111 are coupled axially and mobile contact levers 112, 113 are moved before them, either simultaneously by an energy accumulation mechanism such as 115 which is triggered as above by the action of a coil 114, or else simultaneously by mechanical transmissions means 117 associated with this coil. It is also possible to provide for a combination of these means.

In the embodiments described above, both contacts are mobile; comparable results can also be obtained if one of the contacts is fixed, e.g. contact 50 shown in FIG. 5; in this case the latter does not lie in the path followed by the screen 51.

Lastly, it is possible for the two mobile contacts 53, 52, used as before, to be brought to bear in the idle position on a common intermediate contact 55, see FIG. 6, which is borne by screen 54 and which penetrates right into a slot 57 to ensure arc shearing, preferably against a heel 56 of the screen.

An intermediate contact of this type has the advantage that it cascades two arc voltages.

In the provisions described above, the screen receives a thrust from the right hand side of the figures; in the layout shown in FIG. 7, the screen 85 is pulled from the left of the figure, because the end 86 of this screen is joined to the bottom 87 of sheath 88. Here also the part 89 supporting contacts 90, 91 has a bottom 92, but the latter has two openings 93, 94 which on one hand enable the pressure prevailing in each chamber 95*a*, 95*b* to be transmitted to the volumes 96*a*, 96*b* placed between the first bottom and the bottom 87 of sheath 88 and hence to move the latter, and on the other hand, enables the gas contained in the chambers to be vented through outlets 97, 98 of the sheath. In order to shear the arc, the screen has an slot 100 through which the mobile contact(s) pass, and passes with a functional clearance through an opening 101 in the bottom 92 with the same section; thanks to lateral guides and baffles comparable to those used in FIG. 2, the screen establishes efficient electrical insulation between chambers 95*a*, 95*b*, 96*a*, 96*b* when slot 100 is blocked in opening 101.

A variation of the apparatus described above, illustrated in FIG. 8, uses a bond between the screen and the sheath comparable to the one illustrated previously.

The insulating part 62 which here receives two contact levers 63, 64 has no bottom, but in the plane PP' it has a central rib 65 with an opening 66 into which the two contacts 67, 68 enter. A sheath 69 with a bottom 70 also has a cylindrical skirt 71 which slides on surface 62*s* of the insulating part; this sheath which includes at least one flat screen parallel to the longitudinal plane PP' such as 72 which bears on rib 65 and has an opening 65*g*, can also have another screen 73. This screen, or these two screens, extend laterally up to the skirt, defining two half-chambers 74*a*, 74*b* which only communicate in the idle position of the sheath, see FIG. 8; as previously vents 75*a*, 75*b* provide an outlet to the atmosphere in a particular operating position of the sheath; an outlet 77 may be provided between the end 78 of the rib and the bottom of the sheath to enable or control air intake into the volume 80 when the sheath is pushed by the gas in the direction of the arrow F.

All the provisions mentioned hereabove to operate the contacts and as applicable to arrange for an intermediate contact are also applicable here, provided the latter is located in the opening 66.

Although neither position limitation devices nor shock-absorbers for screen and sheath movement, nor resetting means designed to return them to the idle position after operating have been explicitly described, their presence and operation should be mentioned in all the variations.

In all the different embodiments and implementations of the switch according to the invention, the bottom of the sheath, which can if required have calibrated openings connected or not to the atmosphere to reduce the pressure, acts as a driving component for the sheath and the screen coupled to it with or without any axial play. The section of this sheath, which for technical convenience has been illustrated as circular, can also have any other shape inasmuch as this sheath and the contact support part can be made by molding suitable plastics;

Although for the sake of drawing simplification contact pressure springs and flexible conductors to supply power to contact levers have not always been shown, it must be inferred that these items, which are well known as such, are provided for in the switch or in association therewith, as well as the means to reduce external nuisance (noise, smoke) caused by the arcing.

If the switch is applied to a breaking device with a fairly high rated steady-state current, manual or electromagnetic mechanical means shall naturally be implemented to take care of the circuit opening and closing operations the switch is designed for; in this case also, resetting means designed to return the sheath to its idle position shall be associated with these different controlling devices.

What is claimed is:

1. An electric switching device comprising inside a housing two contacts movable with respect to each other between an open state and a closed state, an insulating screen that moves rapidly between said contacts in order to destabilize the arc generated between the opening contacts by shearing it against a neighbouring insulating surface, an insulating support piece on which are mounted said contacts, a mobile insulating sheath having a skirt and a bottom, said insulating sheath being slidably mounted around said insulating support piece and delimiting therewith an internal variable volume housing said contacts, said bottom acting as a driving component of the sheath when exposed to the gas pressure generated by the arc of the separating contacts and said screen being displaced by the motion of the sheath at least at the moment when the arc is being sheared.

2. Switching device according to claim 1, wherein said screen passes through a first wall of the support piece and enters a slot in a second wall, whereas a chamber is enclosed between these two walls.

3. Switching device according claim 1, wherein said skirt is provided with at least an opening which communicates with the atmosphere in a particular position of the sheath.

4. Switching device according to claim 1, wherein said skirt has an end portion located opposite to said bottom and said screen is axially joined to said end portion by a mechanical connection.

5. Switching device according to claim 1, wherein said screen is joined axially to the sheath in an area near the bottom of the sheath.

6. Switching device according to claim 5, wherein said contacts are housed between first and second opposite walls of a chamber formed inside said fixed insulating support piece, said screen is provided with an opening for contacts and passes through a first slot provided in said first wall and enters a second slot provided in said second wall, and said first wall is provided with at least a fluid transfert opening which communicates with said internal volume.

7. Switching device according to claim 5, wherein said insulating support piece comprises a third wall which extends parallel to said screen and in the proximity thereof, said third wall having an opening which communicates with an opening provided in said screen in the closed state of the switching device to let the contacts through.

8. Switching device according to claim 1, wherein at least one of the switch contacts is fixed and is not located in the path of the screen.

9. Switching device according to claim 1, which comprises a pivoting lever on which is fixed one of said contacts, said switching device comprising a U-shaped magnetizable part which surrounds said lever, in order to develop electro-magnetic forces in the lever which are compounded with electro-dynamic repulsion forces acting on it.

10. Switching device according to claim 1, wherein electro-magnetic coil devices in series with the contacts cause an initial motion of the sheath.

11. Switching device according to claim 1, wherein electro-magnetic coil devices cause an initial opening movement of the contacts assembled in series with these devices.

12. Switching device according to claim 1, wherein the sheath has a cylindrical revolution shape and is associated with shock-absorbing and resetting devices.

* * * * *